US007762313B2

(12) United States Patent
Darby

(10) Patent No.: US 7,762,313 B2
(45) **Date of Patent: *Jul. 27, 2010**

(54) COOLANT SENSOR AND BLEED VALVE

(75) Inventor: Eric Darby, Boston, MA (US)

(73) Assignee: Chrysler Group LLC, Auburn Hills, MI (US)

( * ) Notice: Subject to any disclaimer, the term of this patent is extended or adjusted under 35 U.S.C. 154(b) by 202 days.

This patent is subject to a terminal disclaimer.

(21) Appl. No.: 12/027,295

(22) Filed: Feb. 7, 2008

(65) Prior Publication Data

US 2008/0121366 A1 May 29, 2008

Related U.S. Application Data

(62) Division of application No. 10/700,244, filed on Nov. 3, 2003, now Pat. No. 7,341,097.

(51) Int. Cl.
*G01K 13/02* (2006.01)
*G01K 1/14* (2006.01)

(52) U.S. Cl. ..... 165/11.1; 137/551; 73/198; 73/273; 73/866.5; 374/147; 251/318; 251/319

(58) Field of Classification Search ..... 165/11.1; 137/551; 73/866.5, 273, 198; 374/147; 251/318, 251/319

See application file for complete search history.

(56) References Cited

U.S. PATENT DOCUMENTS 899,201 A 9/1908 Braybrook
3,007,340 A 11/1961 Kraftson
3,691,846 A * 9/1972 Ingold ..... 73/866.5
3,718,157 A 2/1973 Siebentritt et al.
5,829,880 A 11/1998 Diedrich
5,853,071 A 12/1998 Robinson
6,554,322 B2 * 4/2003 Duong et al. ..... 285/305
6,570,375 B2 * 5/2003 Stroeters et al. ..... 324/173
6,772,652 B2 8/2004 Cronimus
7,341,097 B2 * 3/2008 Darby ..... 165/11.1

* cited by examiner

*Primary Examiner*—John K Ford
(74) *Attorney, Agent, or Firm*—Ralph E. Smith

(57) ABSTRACT

A coolant sensor doubles as a bleed valve for purging trapped air from a cooling system. The sensor slides into a port placing a sensor element in contact with the coolant. The sensor includes a pair of encircling o-rings for sealing the system from atmosphere in one position and permitting bleeding in a second position. The bleed channel is in the sensor port between the o-rings. The sensor is moved so the innermost o-ring clears the narrow opening into the cooling system. The outermost o-ring maintains a seal to keep the coolant from leaking out of the sensor port. The sensor is held in either position by a horseshoe clip or by a bayonet arrangement, the horseshoe clip arrangement including multiple apertures for each position, the bayonet having a position to provide for safe bleeding of air from the cooling system without completely removing the sensor from its retention port.

9 Claims, 2 Drawing Sheets

COOLANT SENSOR AND BLEED VALVE

CROSS-REFERENCE TO RELATED APPLICATIONS

This application is a Divisional of U.S. patent application Ser. No. 10/700,244 filed Nov. 3, 2003 now U.S. Pat. No. 7,341,097.

STATEMENT REGARDING FEDERALLY SPONSORED RESEARCH

Not applicable.

BACKGROUND OF THE INVENTION

1. Field of the Invention

The invention relates to a combination temperature sensor and bleed valve for an automobile cooling system.

2. Description of Related Art

In an automobile cooling system, it is well known to provide a sensor for detecting the temperature of the coolant and transmitting the detected temperature to an operator-read temperature gauge and to an engine control system. A known practice is to provide a sensor with an externally threaded body that is received by an internally threaded aperture in the cooling system in a sealed fashion to prevent leaks. More recent practice is to have the sensor mounted in a component associated with the engine block or intake manifold. This component is often molded of a plastic or composite material. This has necessitated incorporating a metallic insert into the molded plastic or composite, as the composite generally lacks the shear strength for directly molding the threads. The metallic insert has also therefore been known to break loose from the plastic molding when subjected to excessive shear. The process of adding the metallic inserts to the plastic molding also adds to the time and cost of manufacture of the molding.

Coolant sensors are also known that slide into a smooth opening and have an external seal, such as an o-ring, for sealing the opening against coolant leaks. Such a coolant sensor is generally held in the smooth opening by a retainer such as a "horseshoe" clip engaging a slot in the surface of the plastic molding.

A means of releasing trapped air is another well-known and necessary component in an automobile cooling system. The radiator can provide the high point required for releasing trapped air, but is not necessarily the high point for the entire cooling system. Portions of the cooling system will trap air that cannot escape through the radiator, which has necessitated installation of a bleed valve at an additional high point. A common practice has been to use a known brake bleeder-type valve. This threaded attachment requires another metallic insert in the plastic or composite molding, subject to the same limitations in strength and time of fabrication previously discussed. This need for an additional fitting on the plastic molding also increases the size and the cost of the molding.

It would be advantageous to improve the reliability of the coolant sensor and bleed valve installations in these composite moldings, preferably eliminating the need for the extra time, cost and space necessary for the separate bleed valve.

BRIEF SUMMARY OF THE INVENTION

In the combination of a coolant sensor and connection port for selectively sealing an automotive cooling system, the connection port having an inner portion fluidly connected to a cooling system fluid channel and an open outer portion for receiving the coolant sensor, the inner portion having a first diameter and the outer portion having a second diameter, and a bleed channel fluidly connected to the outer portion, and the coolant sensor adapted for insertion into the connection port and retention in a first position and a second position, having a first portion forming a seal between the fluid channel and the connection port in the first position, and a second portion forming a seal at the outer portion of the connection port, the bleed channel is fluidly connected to the outer portion of the connection port between the first and second portions of the coolant sensor in the first position, and is fluidly connected to the cooling system fluid channel with the coolant sensor in the second position.

A combination sensor and bleed mechanism for a fluid handling system comprises an access conduit fluidly connected between the fluid handling system and the atmosphere and including a main channel and a bleed channel, a sensor assembly adapted for insertion into the access conduit and comprising a sensor body having a first end and a second end, the first end housing a sensing element and the second end comprising an interface in communication with the sensing element through the sensor body, the sensor body further having a first section proximate the first end and a second section longitudinally spaced from the first section, a sealing element adapted to form a seal between the sensor assembly and the access conduit, and a retention element, wherein the retention element is adapted to secure the sensor assembly in the access conduit in a first position sealing the access conduit from the fluid handling system and in a second position wherein the bleed channel is fluidly connected with the fluid handling system.

BRIEF DESCRIPTION OF THE SEVERAL VIEWS OF THE DRAWINGS

The present invention will become more fully understood from the detailed description and the accompanying drawings, wherein.

DETAILED DESCRIPTION OF THE INVENTION

Figure 1:
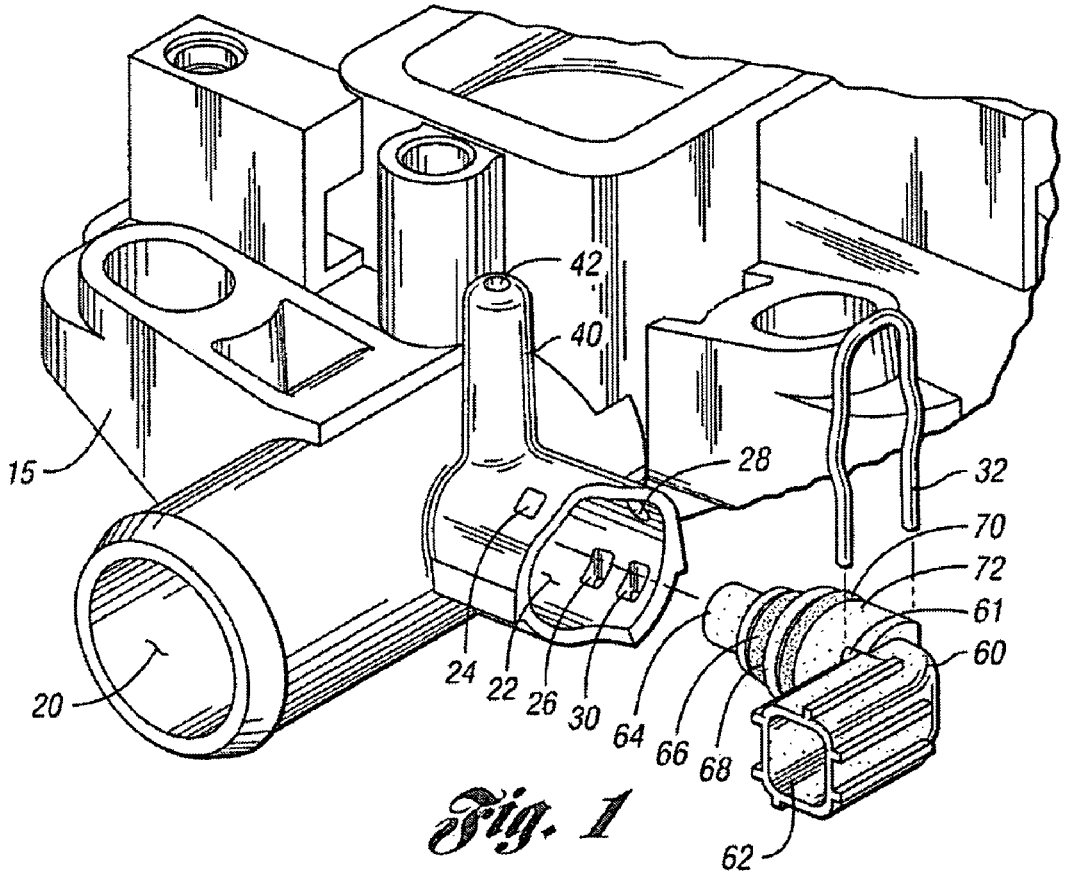
FIG. 1 is an exploded perspective view of an automobile cooling system component and a combination sensor and bleed valve according to the invention.

FIG. 1 illustrates an automotive system component 15 incorporating a portion of the automotive cooling system 20. An access port 22 provides an installation point for a sensor 60 that can report the condition, specifically the temperature, of the coolant passing through the cooling system 20 to the engine controller. The sensor 60 is secured within the access port 22 with a horseshoe clip 32.

Figure 2:
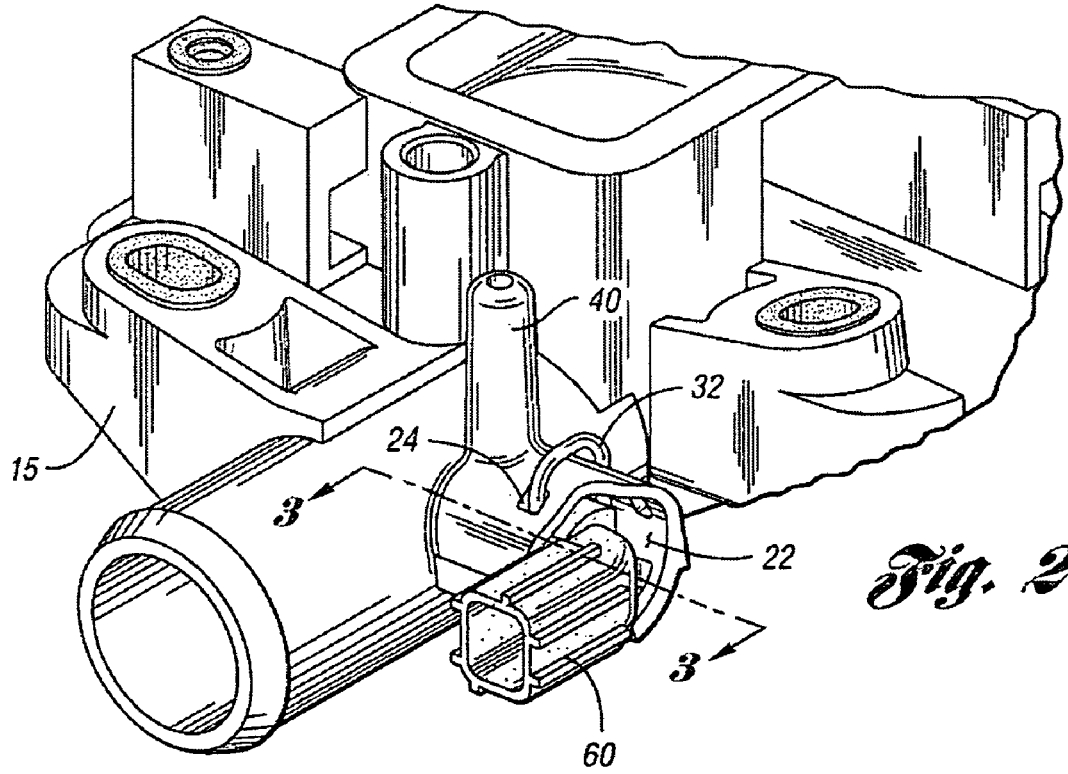
FIG. 2 is a perspective view of the automobile cooling system component with installed combination sensor and bleed valve of FIG. 1.

Referring to FIG. 2, the sensor 60 has been inserted fully into the access port 22 and secured by horseshoe clip 32. Clip 32 has been inserted into a first set of apertures 24, 26 in the mouth of access port 22 so as to engage a corresponding groove 61 on sensor 60 to positively position sensor 60 within access port 22 in a first, sealing position within access port 22. Sensor 60 can also be secured in a second, bleeding position, outward of the sealing position, by the horseshoe clip 32. A second set of apertures 28, 30 in the mouth of access port 22 is positioned for engagement by horseshoe clip 32 to secure sensor 60 in the bleeding position.

Figure 3:
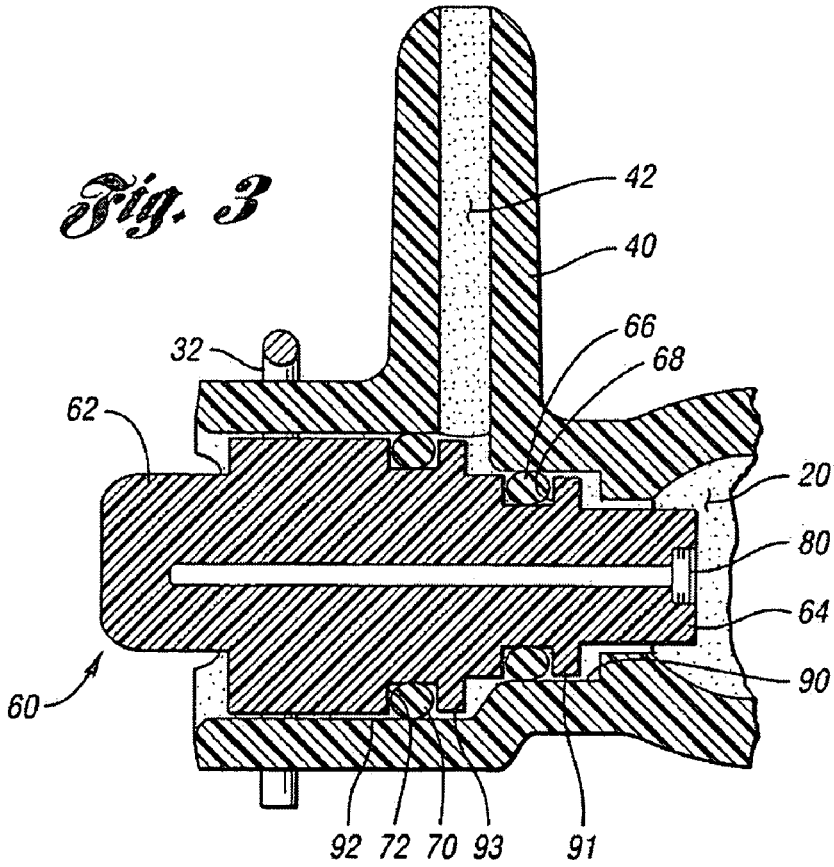
FIG. 3 is a cross-sectional view taken through line 3-3 of FIG. 2.
Figure 4:
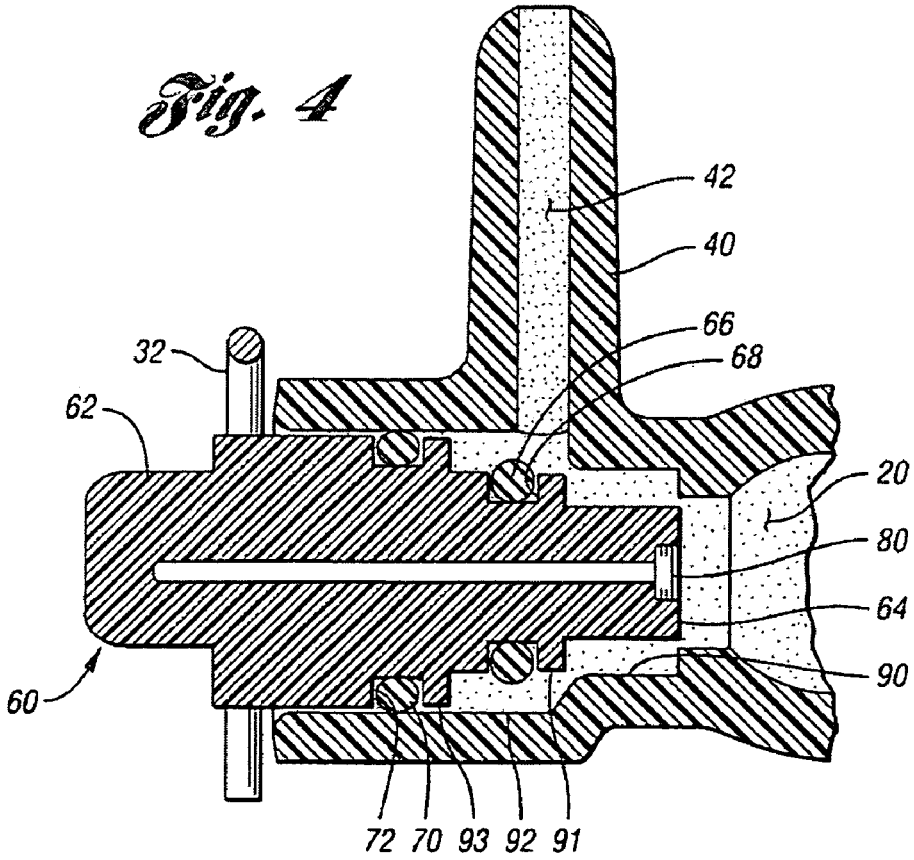
FIG. 4 is a cross-sectional view according to FIG. 3 with the combination sensor and bleed valve in a system-bleeding position according to the invention.

FIGS. 3-4 are cross-sectional views of sensor 60 within access port 22 and depict the sensor 60 in the sealing and bleeding positions, respectively. As shown in FIGS. 1 and 3-4, sensor 60 includes an elongate probe portion 64 which is adapted to be inserted fully within access port 22. A sensing element 80 is positioned at the nose of sensor 60 for contact with coolant in the cooling system 20.

The probe portion 64 includes two distinct longitudinal sections having different diameters. The first section 91 has a first diameter corresponding with the innermost portion 90 of the access port 22. A shoulder transitions the sensor 60 to a base section 93 having a second diameter greater than the first diameter, corresponding to an outermost portion 92 of the access port 22.

The first section 91 includes an o-ring seal 66 carried within an annular groove 68 circumscribing the first section 91. The o-ring seal 66 is selected to provide a fluid tight seal between first section 91 and the wall of innermost portion 90 of the access port 22, sufficient to withstand pressures found in the cooling system 20. A second o-ring 70 is positioned in an annular groove 72 circumscribing base section 93 of sensor 60 for forming a seal between base section 93 of sensor 60 and outermost portion 92 of access port 22.

Outermost portion 92 of access port 22 includes an upwardly directed bleed channel 42 integrally formed 40 in the system component 15. Access port 22 is positioned at an upper extent of the cooling system 20 so that any air trapped in the cooling system 20 will rise to the access port 22 and can be released from the cooling system 20.

In an operational mode, the sensor 60 is fully inserted into access port 22 and secured in place by horseshoe clip 32. O-ring 66 forms a fluid tight seal between first section 91 and innermost portion 90, separating the cooling system 20 from the atmosphere. Sensing element 80 is in contact with coolant flowing in the cooling system 20.

The sensor 60 can be completely removed from access port 22 for replacement by removing horseshoe clip 32 and sliding sensor 60 out of access port 22. When trapped air must be bled from the cooling system 20, the sensor 60 can be held in an intermediate position by the horseshoe clip 32, which passes through the second set of apertures 28, 30 in the mouth of access port 22. Referring specifically to FIG. 4, which illustrates sensor 60 in the intermediate position, o-ring 66 of first section 91 has been shifted into the outermost portion 92 of access port 22 so that it no longer provides a fluid tight seal with the wall of the access port 22. Rather, the bleed channel 42 is fluidly connected with the cooling system 20, so that any air in the cooling system 20 can escape to the atmosphere.

O-ring 70 remains within the outermost portion 92 of access port 22, maintaining a seal between base section 93 of sensor 60 and outermost portion 92 of access port 22. This prevents coolant from passing around sensor 60 through the mouth of the access port 22 and onto the electrical connection 62 to the sensor 60 or the service technician's hand. Any coolant released from cooling system 20 during the bleeding operation is released through the bleed channel 42.

After the cooling system 20 has been bled through the bleed channel 42, the sensor 60 must be returned to the operational position. The horseshoe clip 32 is removed from the second set of apertures 28, 30 and the sensor 60 pushed fully into access port 22. Horseshoe clip 32 is then re-inserted into the first set of apertures 24, 26 to secure the sensor 60.

In a further embodiment of the invention, the sensor and access port are configured with a bayonet style interface (not shown) including complementary engagement and incline ramp surfaces on the exterior of the sensor and the interior of the access port. The sensor is inserted directly into the access port until the bayonet mount engages. In this position, the sensor is in the bleeding position, and is held within the access port by friction between the second o-ring and the wall of the outermost portion of the access port. The bayonet mount may in the alternative include a first detent position for situating the sensor in the bleeding position. To place the sensor into the operational position, the sensor can be rotated so that the bayonet mount draws the sensor inwardly until the first o-ring forms a seal within the innermost portion of the access port. The bayonet mount can be configured to resist expulsion of the sensor by the pressure of the cooling system through the mechanism of friction, a shallow incline angle of the ramp surfaces, the inclusion of detents in the ramp surfaces, the inclusion of detents at the opening of the access port, or any combination thereof.

While the invention has been described in the specification and illustrated in the drawings with reference to a preferred embodiment, it will be understood by those skilled in the art that various changes may be made and equivalents may be substituted for elements thereof without departing from the scope of the invention as defined in the claims. In addition, many modifications may be made to adapt a particular situation or material to the teachings of the invention without departing from the essential scope thereof. Therefore, it is intended that the invention not be limited to the particular embodiment illustrated by the drawings and described in the specification as the best mode presently contemplated for carrying out this invention, but that the invention will include any embodiments falling within the scope of the appended claims.

What is claimed is:

1. A combination sensor and bleed mechanism for a fluid handling system comprising:

an access conduit fluidly connected between the fluid handling system and the atmosphere and including a main channel and a bleed channel;

a sensor assembly adapted for insertion into the access conduit and comprising a sensor body having a first end and a second end, the first end housing a sensing element and the second end comprising an interface in communication with the sensing element through the sensor body, the sensor body further having a first section proximate the first end and a second section longitudinally spaced from the first section;

a sealing element adapted to form a seal between the sensor assembly and the access conduit; and a retention element comprising longitudinally spaced first and second retention apertures in the main channel and a clip member adapted to engage one of the first and second retention apertures to secure the sensor assembly in the access conduit;

wherein the clip member is adapted to engage the first retention aperture and secure the sensor assembly in the access conduit in a first position sealing the access conduit from the fluid handling system, and is adapted to engage the second retention aperture and secure the sensor assembly in a second position whereby the bleed channel is fluidly connected with the fluid handling system.

2. The mechanism of claim 1, wherein the sealing element is adapted to form a seal between the access conduit and the first section of the sensor body with the sensor assembly in the first position.

3. The mechanism of claim 2, further comprising a second sealing element adapted to form a seal between the access conduit and the second section of the sensor body with the sensor assembly in the first position.

4. The mechanism of claim 2, further comprising a second sealing element adapted to form a seal between the access conduit and the second section of the sensor body with the sensor assembly in the second position.

5. The mechanism of claim 4, wherein the sealing element is adapted to be spaced apart from the access conduit when the sensor assembly is in the second position such that the bleed channel is fluidly connected with the fluid handling system.

6. The mechanism of claim 4, wherein the sealing element and the second sealing element each comprise an o-ring.

7. The mechanism of claim 2, wherein the first section of the sensor body has a first diameter and the second section of the sensor body has a second diameter greater than the first diameter.

8. The mechanism of claim 2, wherein the main channel includes an inner portion having a first diameter and an outer portion having a second diameter greater than the first diameter.

9. The mechanism of claim 8, wherein the bleed channel is fluidly connected to the main channel at the outer portion.

* * * * *